US009090838B2

(12) United States Patent
Al Chalabi et al.

(10) Patent No.: US 9,090,838 B2
(45) Date of Patent: Jul. 28, 2015

(54) ACTIVE REFORMER

(76) Inventors: Rifat Al Chalabi, Fanwood, NJ (US); Henry Ophneil Perry, Nottingham (GB)

( * ) Notice: Subject to any disclaimer, the term of this patent is extended or adjusted under 35 U.S.C. 154(b) by 1240 days.

(21) Appl. No.: 12/922,523

(22) PCT Filed: Mar. 18, 2009

(86) PCT No.: PCT/GB2009/000708

§ 371 (c)(1),
(2), (4) Date: Oct. 4, 2010

(87) PCT Pub. No.: WO2009/115784

PCT Pub. Date: Sep. 24, 2009

(65) Prior Publication Data

US 2011/0012064 A1 Jan. 20, 2011

Related U.S. Application Data

(60) Provisional application No. 61/037,695, filed on Mar. 18, 2008.

(30) Foreign Application Priority Data

Mar. 18, 2008 (GB) ..... 0805020.5

(51) Int. Cl.

| | |
|---|---|
| ***C10K 3/04*** | (2006.01) |
| ***C10J 3/66*** | (2006.01) |
| ***C10J 3/46*** | (2006.01) |

(Continued)

(52) U.S. Cl.

CPC .. *C10J 3/66* (2013.01); *C10J 3/466* (2013.01); *C10J 3/723* (2013.01); *C10K 3/006* (2013.01); *C10K 3/04* (2013.01); *C10J 2300/1223* (2013.01); *C10J 2300/1823* (2013.01)

(58) Field of Classification Search

USPC ..... 252/373; 48/197 R

See application file for complete search history.

(56) References Cited

U.S. PATENT DOCUMENTS

| | | | |
|---|---|---|---|
| 4,597,776 | A | 7/1986 | Ullman et al. |
| 5,344,848 | A | 9/1994 | Steinberg et al. |

(Continued)

FOREIGN PATENT DOCUMENTS

| | | | |
|---|---|---|---|
| EP | 1510567 | A1 | 3/2005 |
| GB | 2018818 | A | 10/1979 |

(Continued)

OTHER PUBLICATIONS

International Search Report dated Jun. 25, 2010 from the corresponding International Application No. PCT/GB2009/000708 filed Mar. 18, 2009.

(Continued)

*Primary Examiner* — Stanley Silverman
*Assistant Examiner* — Syed Iqbal
(74) *Attorney, Agent, or Firm* — Young Basile Hanlon & McFarlane P.C.

(57) ABSTRACT

The invention provides an apparatus and method for producing synthetic gas. The apparatus has a pyrolysis chamber (12) for generating synthetic gas, a reformer unit (14), conduit means (22, 24) forming a circulation loop for repeatedly circulating gases between said pyrolysis chamber and said water-gas shift reaction zone and means for adding hydrogen to said gas circulating in said loop by way of a water-gas shift reaction.

26 Claims, 1 Drawing Sheet

(51) Int. Cl.
*C10J 3/72* (2006.01)
*C10K 3/00* (2006.01)

(56) References Cited

U.S. PATENT DOCUMENTS

| | | | |
|---|---|---|---|
| RE35,377 | E | 11/1996 | Steinberg et al. |
| 2002/0110503 | A1 | 8/2002 | Gittleman et al. |
| 2005/0032920 | A1 | 2/2005 | Norbeck et al. |
| 2008/0014126 | A1 | 1/2008 | Bender et al. |
| 2008/0021123 | A1 | 1/2008 | Norbeck et al. |

FOREIGN PATENT DOCUMENTS

| | | | | |
|---|---|---|---|---|
| GB | 2277528 | A | | 2/1994 |
| WO | 03066517 | A1 | | 8/2003 |
| WO | WO 03066517 | A1 | * | 8/2003 |
| WO | 2004072207 | A1 | | 8/2004 |
| WO | 2006070018 | A1 | | 7/2006 |
| WO | 2007061616 | A1 | | 5/2007 |
| WO | 2008010993 | A1 | | 1/2008 |
| WO | 2008010994 | A2 | | 1/2008 |
| WO | 2009050494 | A2 | | 4/2009 |

OTHER PUBLICATIONS

Written Opinion of the International Searching Authority dated Jun. 25, 2010 from the corresponding International Application No. PCT/GB2009/000708 filed Mar. 18, 2009.

* cited by examiner

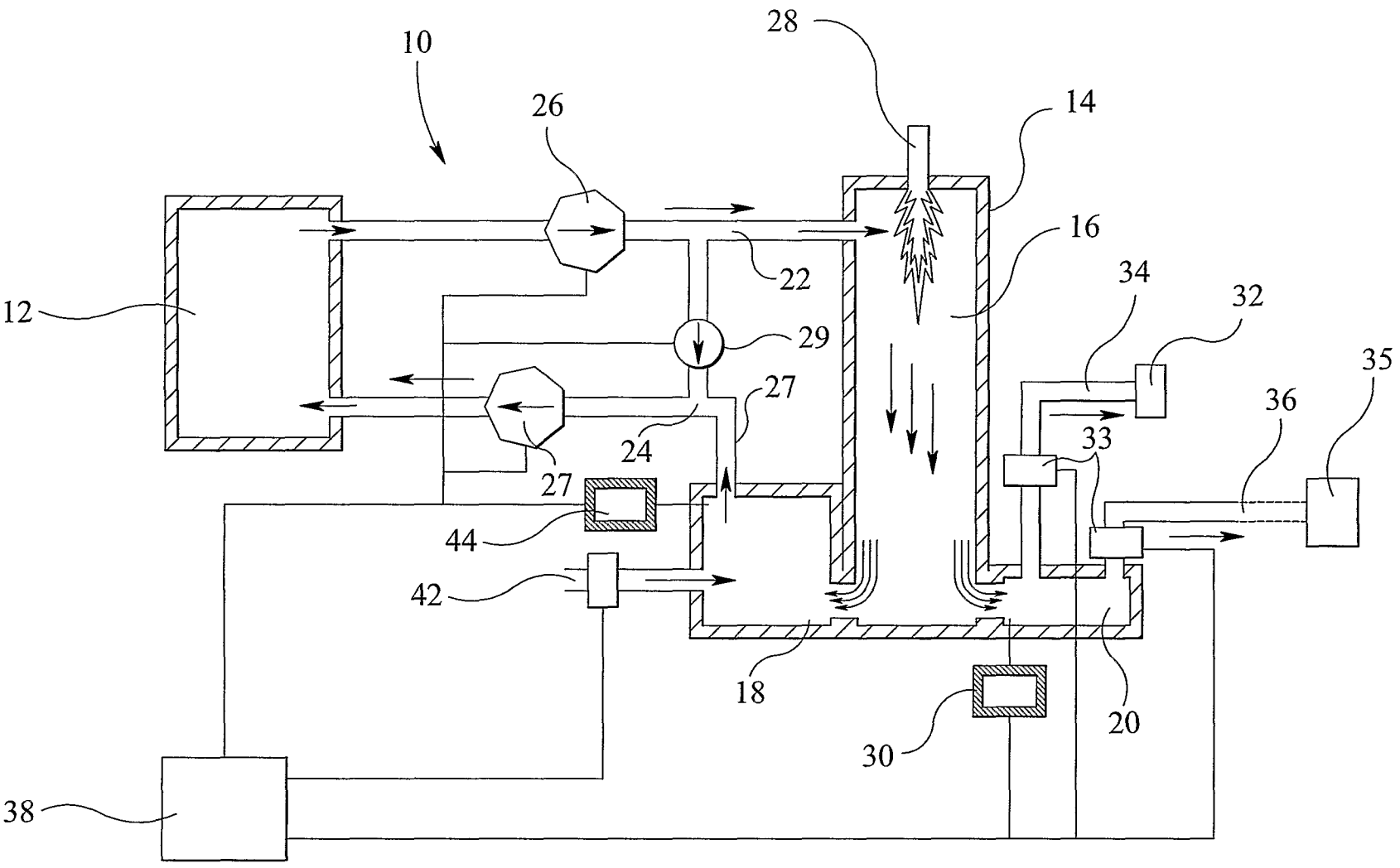
35
36
32
34
33
20
14
16
30
28
22
29
27
18
24
26
27
44
42
10
12
38

ACTIVE REFORMER

FIELD OF THE INVENTION

The present invention relates to a method of producing synthetic gas.

BACKGROUND OF THE INVENTION

Gasification is a process that converts carbonaceous materials, such as biomass, into carbon monoxide and hydrogen by reacting the raw material at high temperatures with a controlled amount of oxygen. The resulting gas mixture is called synthetic gas or syngas. Synthetic gas is made predominately of CO (Carbon Monoxide), and Hydrogen. These two elements are the basic building blocks for the Alcohols (Methanol, Ethanol, Propanol, etc.).

Gasification is an efficient method for extracting energy from many different types of organic materials and provides clean waste disposal. Gasification is more efficient than direct combustion of the original fuel, particularly since more of the organics contained in the processed material is converted into energy (higher thermal efficiency).

Syngas may be burned directly in internal combustion engines or used to produce alcohols such as methanol, ethanol and propanol, and also hydrogen. Gasification of fossil fuels is currently widely used on industrial scales to generate electricity.

Typically the generation of synthetic gas in a gasifier goes through several processes.

Pyrolysis

The first process is pyrolysis and this occurs as the temperature inside the gasifying device is raised with an oxygen deprived atmosphere, heating up the carbonaceous material. The pyrolysis process is the gasification of the organics with zero oxygen content. To achieve synthetic gas from the organic material the process could be either a gasification process (partial oxidation of the organic material), or Pyrolysis (zero oxidation of the organic material). Pyrolysis produces more synthetic gas, since it does not oxidize any of the synthetic gas it produces.

Reformer Process

This is effected in a high temperature reformer chamber, which receives the synthetic gases from the pyrolysis chamber. In the reformer chamber the synthetic gas temperature is raised to a high temperature (>900° C.) so as to disassociate the tars into simpler carbon molecules. When steam is added into the reformer chamber the ratio of Hydrogen to Carbon Monoxide is altered, this is achieved via the use of the water gas shift reaction (shift reaction).

The shift reaction is an exothermic chemical reaction in which water and carbon monoxide react to form carbon dioxide and hydrogen:

$$CO+H_2O \rightarrow CO_2+H_2 \quad (1)$$

The shift reaction increases the amount of hydrogen produced. However, the shift reaction is an endothermic reaction and requires a high temperature. The shift reaction is sensitive to temperature with the tendency to shift to the products as the temperature increases. As a result, the shift reaction absorbs considerable energy from the reformer chamber, making it cost-prohibitive. Attempts to lower the reaction temperature using catalysts have not been particularly successful.

More importantly, the shift reaction also consumes Carbon monoxide from the synthetic gas. Carbon monoxide is required to produce the require hydrogen to CO ratio for the production of alcohols such as methanol, ethanol and propanol.

There is, therefore, an optimal range for the shift operation, where the use of more shift become less beneficial as both the CO consumption and Energy consumption would be too great.

SUMMARY OF THE INVENTION

The present invention seeks to provide an improved method for generating synthetic gas.

Accordingly, the present invention provides apparatus for producing synthetic gas comprising: a pyrolysis chamber for generating synthetic gas; a reformer unit; conduit means forming a circulation loop for repeatedly circulating gases between said pyrolysis chamber and said water-gas shift reaction zone; and means for adding hydrogen to said gas circulating in said loop by way of a water-gas shift reaction.

In a preferred embodiment, said reformer unit has a water-gas shift reaction zone; and said apparatus further comprises a control system for monitoring the hydrogen content of the synthetic gas in said reformer unit and controlling the circulation of gas between said pyrolysis chamber and said water-gas shift reaction zone in dependence thereon.

Advantageously, said control system has means for monitoring the composition of the synthetic gas in said reformer unit, and said control system is operable to control the supply of said gas to at least one of a gas synthesizer and a steam generating means in dependence thereon.

Preferably, the apparatus comprises means for controlling movement of gases to said gas synthesizer and said steam generating means, and wherein said control system is operable to control said means thereby to control the supply of said gas to at least one of said gas synthesizer and said steam generating means in dependence thereon.

Preferably, the apparatus further comprises means for injecting steam into said gas in said reformer unit, and said control system is operable to control the injection of steam into said gas in dependence on the hydrogen content of the synthetic gas in said reformer unit.

Preferably, the apparatus further comprises blower means in said conduit means for circulating said gases and said control system is operable to control said blower means in dependence on the hydrogen content of the synthetic gas in said reformer unit.

Advantageously, said reformer unit has a mixing chamber downstream of said water-gas shift reaction zone in said circulation loop and said control system is operable to monitor the hydrogen content of the synthetic gas in said mixing chamber thereby to control the circulation of gas between said pyrolysis chamber and said water-gas shift reaction zone in dependence thereon.

Preferably, said means for injecting steam into said gas in said reformer unit is configured to inject steam into said mixing chamber.

Advantageously, said reformer unit has a collecting chamber between said water-gas shift reaction zone and said gas synthesizer and said steam generating means, and said control system is operable to monitor the composition of the synthetic gas in said collecting chamber.

The pyrolysis chamber may be a batch pyrolysis chamber.

Preferably, said control system is operable to circulate the synthetic gases more than 3 times and up to 24 times between the pyrolysis chamber and the reformer unit. The control system is operable to circulate the synthetic gases more than 3 times and up to 15 times between the pyrolysis chamber and the reformer unit.

Advantageously, the control system is operable to circulate the synthetic gases more than 3 times and up to 10 times between the pyrolysis chamber and the reformer unit.

The present invention also provides a method of producing synthetic gas in a batch process, the method comprising: generating synthetic gas in a pyrolysis chamber; and passing said gas from said pyrolysis chamber to a water gas shift reaction zone to produce a shifted syngas stream having an enriched hydrogen content; wherein said pyrolysis chamber and said water gas shift reaction zone are in a gas circulation loop shifted and said syngas is recirculated through said loop a plurality of times.

In a preferred embodiment, the CO consumed during said reaction in said reaction zone is replenished with hydrogen.

Preferably, the consumed CO is continually replenished.

The synthetic gas is generated in a batch pyrolysis chamber and the synthetic gases circulate through said loop between 3 times and 24 times, preferably, between 3 times and 15 times and preferably between 3 times and 10 times.

The water gas shift reaction zone is conveniently provided in a reformer unit and the passage of the synthetic gas to and from the reformer unit is used to heat the gas.

The reformer unit preferably has a mixing chamber and a collection chamber and the water gas shift reaction zone is provided in said mixing chamber.

In one embodiment the modified synthetic gas is used to gasify the organics in the pyrolysis chamber. The synthetic gas composition is monitored in said reformer Unit to determine the hydrogen content of the synthetic gas and steam is added to said water gas shift reaction zone in dependence on the monitored hydrogen content to promote hydrogen generation.

Ideally, the process is controlled by controlling the rate of gas circulation.

Preferably, each batch of synthetic gas is assessed to determine whether the synthetic gas achieves one or more predetermined control quality control criteria, the batch of synthetic gas being released to the synthesis process in the event that it achieves the required quality control criteria, and otherwise the batch being used to produce steam which is used to enhance the synthetic gas production.

What is proposed in this invention is a process where the CO consumed in the water gas shift reaction is constantly replenished, the energy consumed to produce the Hydrogen is constantly topped, and the resultant synthetic gas quality is tightly controlled.

Furthermore, what is proposed in this invention is a process where the pyrolysis process has a significant boost (increased efficiency) via adjustment of the chemical composition of the hot (oxygen-depleted) gases used to gasify the organics.

Furthermore, what is proposed in this invention is a process where the operation of the pyrolysis system is linked tightly to the operation and atmosphere of the reformer.

Furthermore, what is proposed here is a batch reformer that operates intimately with a batch pyrolysis system to actively producing a controlled quality synthetic gas.

BRIEF DESCRIPTION OF THE DRAWING

The present invention is further described hereinafter, by way of example, with reference to the accompanying drawing which shows a system for generating synthetic gas from organic material.

DETAILED DESCRIPTION OF THE DRAWING

Referring to the drawing, the system 10 has a pyrolysis chamber 12 through which the organic material is passed. The pyrolysis chamber 12 is operated at a temperature range of typically between 500° C. and 700° C., the temperature being generated usually by injection of synthetic gases at high temperatures.

The system also has a reformer unit 14 which has a main chamber 16, mixing chamber 18 and collection chamber 20. The reformer main chamber 16 is connected to the pyrolysis chamber 12 by a loop of ducting in which conduit 22 allows the flow of gases from the pyrolysis chamber 12 into the reformer main chamber 16. Both the mixing chamber 18 and the collection chamber 20 are open to the reformer main chamber 16 to receive gases from the main chamber.

In addition, the mixing chamber 18 is coupled to the pyrolysis chamber 12 by ducting or conduit 24 to allow the flow of gases from the mixing chamber 18 back to the pyrolysis chamber 12. Recirculating fans 26, 27 are provided respectively in the ducting 22 and 24 to force circulation of the gases. A further ducting or conduit 27 allows bypass of the reformer unit and a recirculating fan 29 is provided in the ducting 27 to force circulation of the gases.

The reformer main chamber 16 operates at a temperature of typically 900° C. to 1400° C., the gases being heated and the temperature being achieved and maintained by a burner system 28, typically burning natural gas or similar. In addition, heat is supplied to the reformer main chamber 16 from the partial oxidation of synthetic gas flowing from the pyrolysis chamber 12 into the reformer main chamber 16 via the conduit 22.

Gases passing from the reformer main chamber 16 into the collection chamber 20 are monitored by a first sampling means 30 which measures the synthetic gas composition in the collection chamber. The first sampling means 30 is conveniently a continuous sampling device. From the collection chamber 20 the gases can be directed either to a boiler 32 via conduit means 34 or towards a synthesizer system 35 via conduit 36 for the synthesis of alcohols such as methanol and ethanol.

The control of the movement of gases from the collection chamber 20 through the conduits 34, 36 can be effected by suitable means such as baffles or valves 33 in the conduits, control of which is effected by a control system 38 which controls the baffles or valves in dependence on the signals generated by the sampling means 30.

Where the synthetic gas composition in the collection chamber 20 is monitored by the sampling means 30 as being of high quality and within the required composition range the control system 38 controls the baffles or valves in the ducts 34, 36 to direct the gases along duct 36 towards the synthesizer 35. Where the composition is outside the desired range, the gases are directed along conduit 34 to the boiler 32.

The boiler 32 is used to generate steam which is applied to the reformer mixing chamber 18 via conduit 42.

A second sampling means 44 (also conveniently a continuously sampling device) monitors the composition of the gases in the reformer mixing chamber 18 and controls the fans 26, 27 in dependence on this composition.

The water gas shift reaction takes place in the reformer mixing chamber 18 and the composition of the reformed gases is sampled by the sampling means 44. The energy of the CO which is consumed during the shift reaction in the reaction zone is replenished with a high thermal efficiency gas, hydrogen. The control system 38 controls the recirculating fans 26, 27 in dependence on the signals from the sampling means 44 such that the recirculating fans 26, 27 dictate the level of recirculation between the reformer unit 14 and the pyrolysis chamber 12 in dependence on the composition of the gases monitored by the sampling means 44.

Each recirculating fan pushes the synthetic gas between the chambers. The fans are over-sized to allow the gases to circulate between the chambers at a very high rate. Typically, the recirculating fans 26, 27 are designed and controlled to recirculate the gases between 3 and 24 times prior to their exiting the gas loop towards the collection chamber 20.

It will be appreciated that the organic materials in the pyrolysis chamber 12 are continually heated by the hot gases recirculating via the conduit 24, thus gasifying more organics in the pyrolysis chamber 12. The fan 29 is controlled by the control system to bypass the reformer unit where the temperature of the gas in the pyrolysis chamber 12 attains a desired level, to prevent the gas temperature from reaching too high a level.

The synthetic gas in the reformer mixing chamber 18 is modified by the above-described process to increase the percentage of hydrogen present. This higher percentage hydrogen is also used to gasify the organic material in the pyrolysis chamber 12 and yields a much higher heat transfer capability. At a pyrolysis chamber operating temperature of 600° C., the hydrogen specific heat equals 14.76 Kj/Kg-K, in comparison with natural gas (Oxy-fuel combustion gases) specific heat of 1.76 Kj/Kg-K. The elevated heat transfer capability leads to a much higher heat transfer to the organic material and this in turn translates into a faster release of organic material and a significantly shorter gasification time. The effect, therefore, of the enhanced gasification efficiency is a much improved fuel efficiency and a much improved organic processing capability compared with conventional heated gases processes.

The control system 38 also controls the injection of steam into the reformer mixing chamber 18 via the conduit 42 in dependence on the results of the sampling means 44. Control is conveniently effected by way of a valve 43. The hydrogen content of the synthetic gas in chamber 18 is monitored by the sample means 44 and in dependence on the result, the control system 38 controls the injection of steam to increase or reduce the amount of steam and generation of hydrogen gas. The control system 38 also controls the recirculating fans 26, 27 and thus controls the rate of circulation of the gases.

The advantage of the collection chamber 20 is that the synthetic gas which is produced and which enters the collection chamber is only released to the synthesis process via the conduit 36 when it is of the right quality as sampled by the sampling means 30. If it is not of the right quality it is used for steam generation by the boiler 32 which in turn enhances the production of synthetic gas. In general, the system is designed to provide between minimum 10 and 200 passes of gas round the loop of conduits 22, 24 and through the pyrolysis chamber 12 and reformer unit 14 prior to exiting the loop toward the collection chamber 20 and the following processes.

The present invention allows for a significant level of control of the quality of the resultant synthetic gas. The multiple passes of the synthetic gas around the system as described above is advantageous in that it can be used to gasify more organics in the pyrolysis chamber.

The invention claimed is:

1. An apparatus for producing synthetic gas comprising:

a pyrolysis chamber for generating synthetic gas;

a reformer unit, the reformer unit having a chamber defining a water gas shift zone;

a conduit structure forming a circulation loop for repeatedly circulating gases between said pyrolysis chamber and said water-gas shift reaction zone in the reformer unit;

means for adding hydrogen to said gas circulating in said circulation loop by way of a water-gas shift reaction, wherein the hydrogen adding means include:

a control system for monitoring hydrogen content of the synthetic gas in the reformer unit and controlling the circulation of synthetic gas between the pyrolysis chamber and the water-gas shift reaction zone in dependence thereon; and an injection device configured to inject steam into the synthetic gas in the reformer unit, wherein the control system is operable on the injection device to control the injection of steam into the synthetic gas in dependence on the hydrogen content of the synthetic gas in the reformer unit such that the hydrogen addition means includes interaction between the control system and the reformer unit.

2. The apparatus as claimed in claim 1, wherein said reformer unit has a water-gas shift reaction zone, and wherein the reformer unit includes a mixing chamber downstream of the water-gas shift reaction zone in the circulation loop.

3. The apparatus as claimed in claim 1, wherein said control system has an apparatus for monitoring the composition of the synthetic gas in said reformer unit, and said control system is operable to control the supply of said synthetic gas to at least one of a gas synthesizer and a steam generating means in dependence thereon.

4. The apparatus as claimed in claim 3, further comprising means for controlling movement of gases to said gas synthesizer and said steam generating means, and wherein said control system is operable to control said means thereby to control the supply of said gas to at least one of said gas synthesizer and said steam generating means in dependence thereon.

5. The apparatus of claim 2 further comprising blower means in said conduit means for circulating said gases and said control system is operable to control said blower means in dependence on the hydrogen content of the synthetic gas in said reformer unit.

6. The apparatus of claim 2 wherein said control system is operable to monitor the hydrogen content of the synthetic gas in said mixing chamber thereby to control the circulation of gas between said pyrolysis chamber and said water-gas shift reaction zone in dependence thereon.

7. The apparatus as claimed in claim 6, wherein said means for injecting steam into said gas in said reformer unit is configured to inject steam into said mixing chamber.

8. The apparatus as claimed in claim 3, wherein said reformer unit has a collecting chamber between said water-gas shift reaction zone and said gas synthesizer and said steam generating means, and said control system is operable to monitor the composition of the synthetic gas in said collecting chamber.

9. The apparatus as claimed in claim 1, wherein said pyrolysis chamber is a batch pyrolysis chamber.

10. The apparatus as claimed in claim 1, wherein said control system is operable to circulate the synthetic gases more than 3 times and up to 24 times between the pyrolysis chamber and the reformer unit.

11. The apparatus as claimed in claim 1, wherein said control systemis operable to circulate the synthetic gases more than 3 times and up to 15 times between the pyrolysis chamber and the reformer unit.

12. The apparatus as claimed in 1, wherein said control system is operable to circulate the synthetic gases more than 3 times and up to 10 times between the pyrolysis chamber and the reformer unit.

13. A method of producing synthetic gas in a batch process, the method comprising:

generating synthetic gas in a pyrolysis chamber; and passing said generated synthetic gas from said pyrolysis chamber to a water gas shift reaction zone to produce a shifted syngas stream having an enriched hydrogen content, wherein the water gas shift reaction zone is located in a reformer unit;

wherein said pyrolysis chamber and said water gas shift reaction zone present in the reformer unit are in a gas circulation loop shifted and said shifted syngas stream is recirculated through said gas circulation loop between 3 times and 24 times.

14. The method as claimed in claim 13, wherein CO consumed during said reaction in said water gas shift reaction zone is replenished with hydrogen.

15. A method as claimed in claim 14,wherein the consumed CO is continually replenished.

16. A method as claimed in claim 13, 14 or 15, wherein the synthetic gas is generated in a batch pyrolysis chamber.

17. The method as claimed in claim 13, wherein the synthetic gases circulate through said gas circulation loop between 3 times and 15 times.

18. The method as claimed in claim 13, wherein the synthetic gases circulate through said gas circulation loop between 3 times and 10 times.

19. The method as claimed in claim 13, wherein the water gas shift reaction zone is provided in a reformer unit.

20. The method as claimed in claim 19, wherein the passage of the synthetic gas to and from the reformer unit is used to heat the synthetic gas.

21. The method as claimed in claim 19, wherein the reformer unit has a mixing chamber and a collection chamber and the water gas shift reaction zone is provided in said mixing chamber.

22. The method as claimed in claim 13, wherein the modified synthetic gas is used to gasify the organics in the pyrolysis chamber.

23. The method as claimed in claim 13, wherein the synthetic gas composition is monitored in said reformer unit to determine the hydrogen content of the synthetic gas.

24. The method as claimed in claim 23, comprising adding steam to said water gas shift reaction zone in dependence on the monitored hydrogen content to promote hydrogen generation.

25. The method as claimed in claim 13, further comprising controlling the process by controlling the rate of gas circulation.

26. The method as claimed in claim 13, wherein the synthetic gas is generated in a batch pyrolysis chamber wherein each batch of synthetic gas is assessed to determine whether the synthetic gas achieves one or more predetermined control quality control criteria, the batch of synthetic gas being released to the synthesis process in the event that it achieves the required quality control criteria, and otherwise the batch being used to produce steam which is used to enhance the synthetic gas production.

* * * * *